US007651335B2

(12) United States Patent
Chen

(10) Patent No.: US 7,651,335 B2
(45) Date of Patent: Jan. 26, 2010

(54) RECEPTACLE RF CONNECTOR HAVING INTERFERENTIAL ENGAGEMENT BETWEEN CONTACT TERMINAL AND HOUSING

(75) Inventor: Ming-Ching Chen, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/383,531

(22) Filed: Mar. 25, 2009

(65) Prior Publication Data

US 2009/0247008 A1 Oct. 1, 2009

(30) Foreign Application Priority Data

Mar. 25, 2008 (CN) ..... 2008 2 0033115 U

(51) Int. Cl.
*H01R 12/00* (2006.01)

(52) U.S. Cl. ..... 439/63

(58) Field of Classification Search ..... 439/63, 439/581, 578

See application file for complete search history.

(56) References Cited

U.S. PATENT DOCUMENTS

| | | | | |
|---|---|---|---|---|
| 5,772,470 | A * | 6/1998 | Togashi | 439/582 |
| 6,474,995 | B1 * | 11/2002 | Wu | 439/63 |
| 6,503,100 | B2 * | 1/2003 | Yamane | 439/582 |
| 6,508,668 | B1 * | 1/2003 | Yamane | 439/582 |
| 6,648,653 | B2 * | 11/2003 | Huang et al. | 439/63 |
| 6,902,408 | B2 * | 6/2005 | Yamane | 439/63 |
| 6,997,745 | B2 * | 2/2006 | Ikeda | 439/582 |
| 7,008,235 | B2 * | 3/2006 | Watanabe | 439/63 |
| 7,118,383 | B2 * | 10/2006 | Nagata et al. | 439/63 |
| 7,445,458 | B1 * | 11/2008 | Yamane | 439/63 |

* cited by examiner

*Primary Examiner*—T C Patel
*Assistant Examiner*—Vladimir Imas
(74) *Attorney, Agent, or Firm*—Ming Chieh Chang; Wei Te Chung; Andrew C. Cheng

(57) ABSTRACT

A receptacle RF connector (100) includes an inner conductor (2) having an unsealed tubular section (20) having retention walls (23, 24) configured to extend into a body of a dielectric block (1). Thus, the conductor is securely held within the dielectric block by the engagement of the retention walls and the retention slots (11, 12) so as to avoid the un-stable assembly of the conductor and the dielectric block of the prior art.

20 Claims, 6 Drawing Sheets

RECEPTACLE RF CONNECTOR HAVING INTERFERENTIAL ENGAGEMENT BETWEEN CONTACT TERMINAL AND HOUSING

BACKGROUND OF THE INVENTION

1. Field of the Invention

The present invention relates to an RF connector assembly, and more particularly to a RF connector assembly in which a receptacle RF connector is provided with at least a receptacle contact with a retention portion securely interengaged with a housing of the receptacle RF connector.

2. Description of the Related Art

As shown in FIG. 1, a typical RF receptacle RF connector includes an inner conductor 2', a dielectric block 1' assembled with the conductor 2', and an outer shell 3' integrally molded with the dielectric block 1' as a unit. The conductor 2' includes a base 20' with an unsealed tubular section 23' attached to a first side of the base 20', and a solder leg 21' having a zigzag structure on an opposite second side of the base 20'. The conductor 2' is assembled with the dielectric block 1' mainly by the zigzag structure of the solder leg 21' engaged into a slot defined on the dielectric block 1'. Since there is no reliable interengagement between the contact and the housing, creating a possibility that the conductor 2' may move during mating and disengaging with a mating plug conductor). The reason is when a mating force, generated by the mating action of the receptacle RF connector and a plug connector mating with each other, is exerted on the conductor 2'.

Therefore, there is a need to provide an RF connector assembly including a receptacle RF connector to resolve the above-mentioned problem.

SUMMARY OF THE INVENTION

A receptacle RF connector made according to an embodiment of the present invention includes an inner conductor having a base with opposite first and second sides, and opposite third and fourth sides, a first unsealed tubular section having a portion attached to the first side and defining an axial direction orthogonal to the base, a solder leg disposed on said second side with a solder tail; and retention walls respectively attached to said third and fourth sides, wherein the retention walls are configured to extend into a body of the dielectric block. A dielectric block is assembled with the conductor, the block having a second tubular section disposed outside of the first tubular section of the conductor. An outer shell is integrally molded with the dielectric block as a unit, the outer shell having a third unsealed tubular frame with an axial slit also along said axial direction, and three solder pads being at a same level with said solder tail of the conductor, the third tubular frame spaced from the second tubular section in a radial direction with a predetermined distance. Thus, the conductor is securely held within the dielectric block by the engagement of the retention walls and the retention slots so as to avoid the un-stable assembly of the conductor and the dielectric block of the prior art merely by means of the zigzag solder leg.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
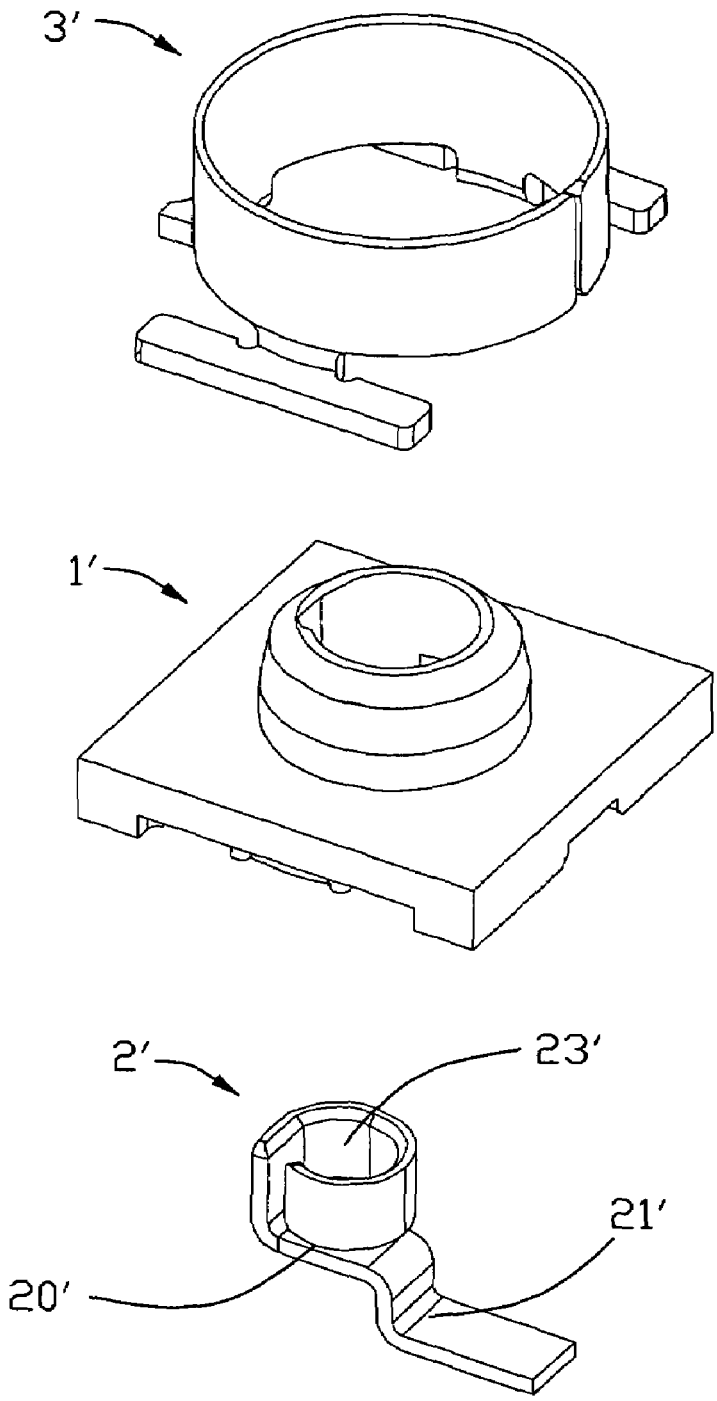
FIG. 1 (PRIOR ART)
FIG. 1 is an explored, perspective view of a conventional receptacle RF connector.
Figure 2:
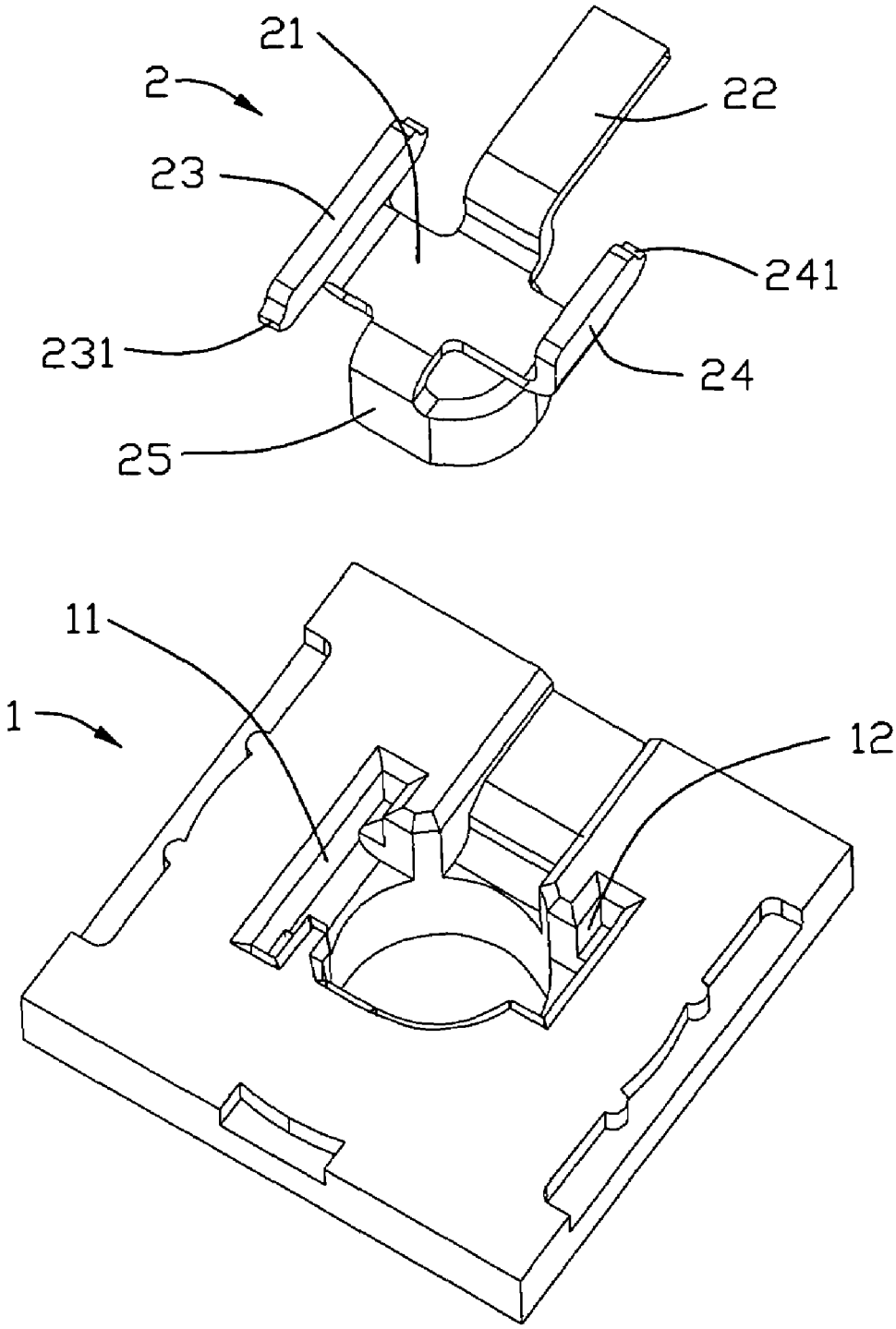
FIG. 2 is an explored, perspective view of a part of a receptacle RF connector including a dielectric block and an inner conductor according to an embodiment of the present invention.
Figure 3:
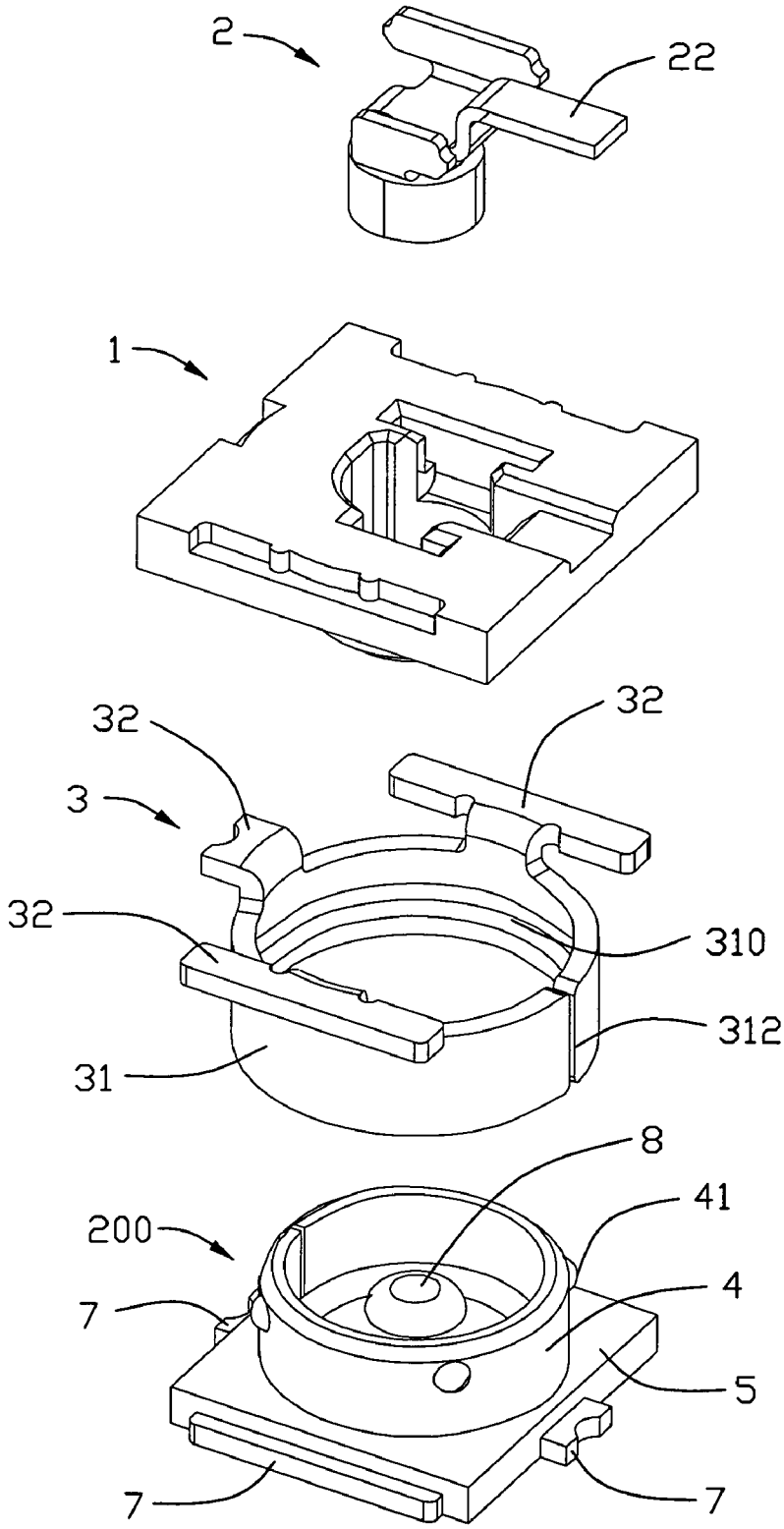
FIG. 3 is an explored, perspective view of an RF connector assembly including the receptacle RF connector of FIG. 2 and a plug connector for mating therewith.
Figure 4:
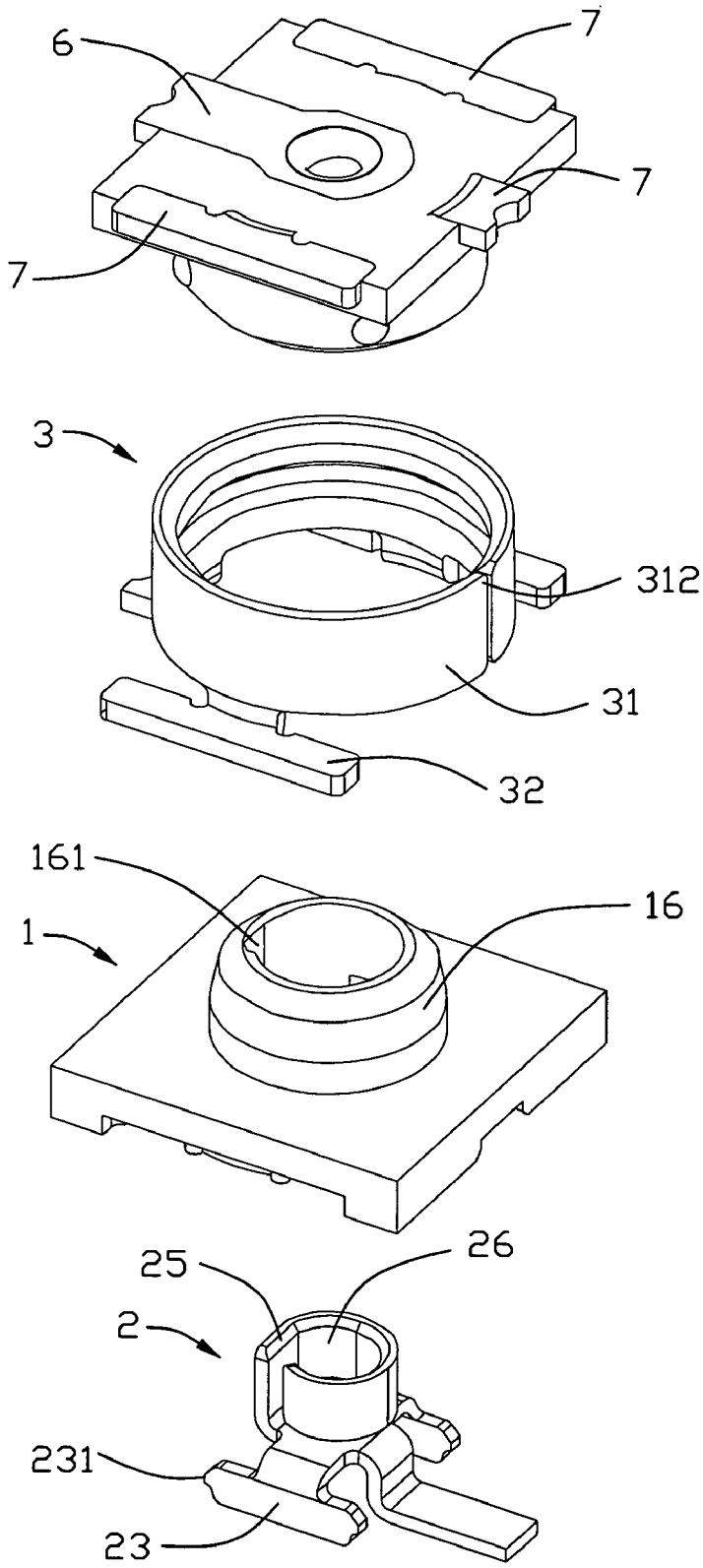
FIG. 4 is an explored, perspective view of the RF connector assembly of FIG. 3, but viewed from another aspect.
Figure 5:
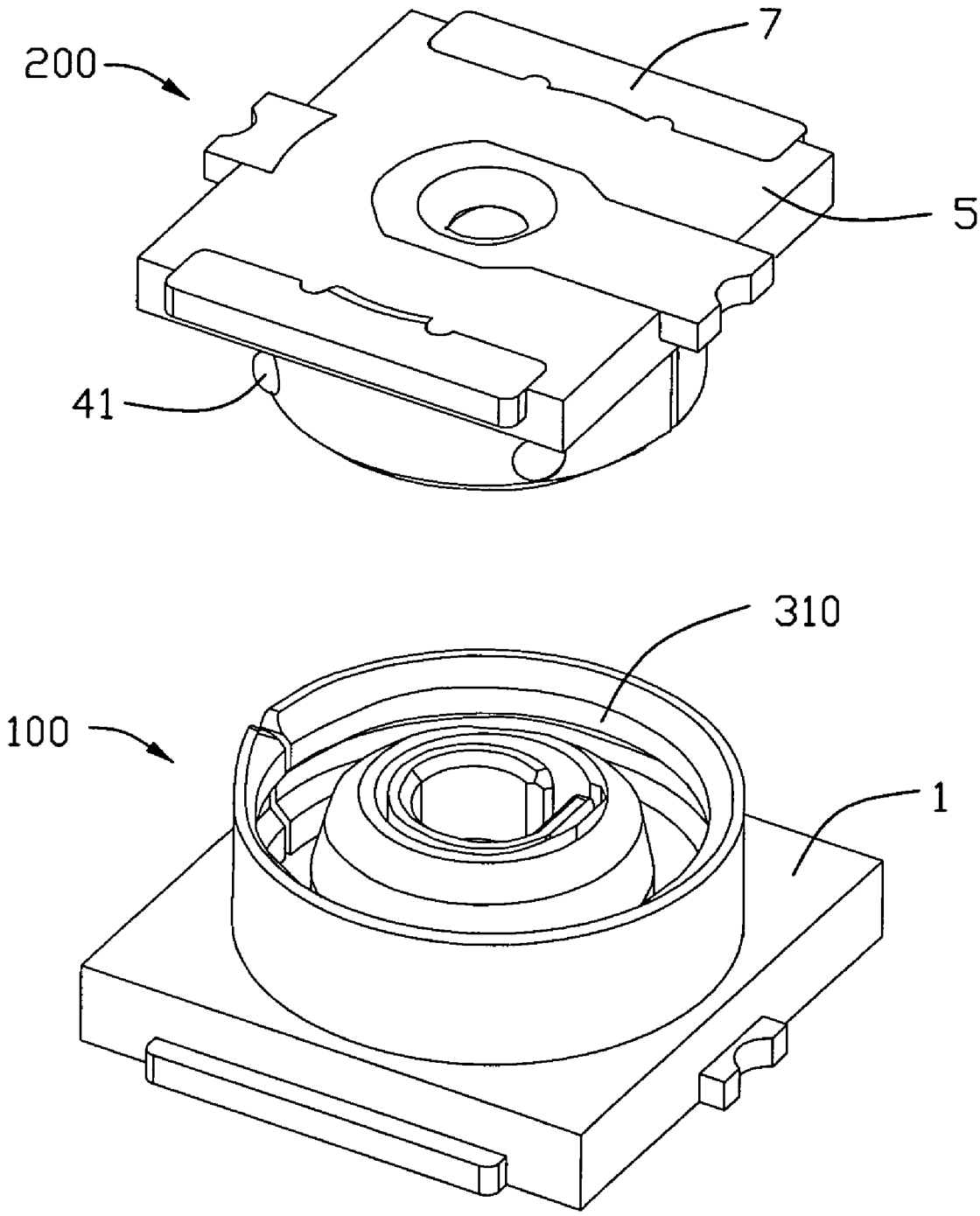
FIG. 5 is a partly-assembled, perspective view of the RF connector assembly of FIG. 3.
Figure 6:
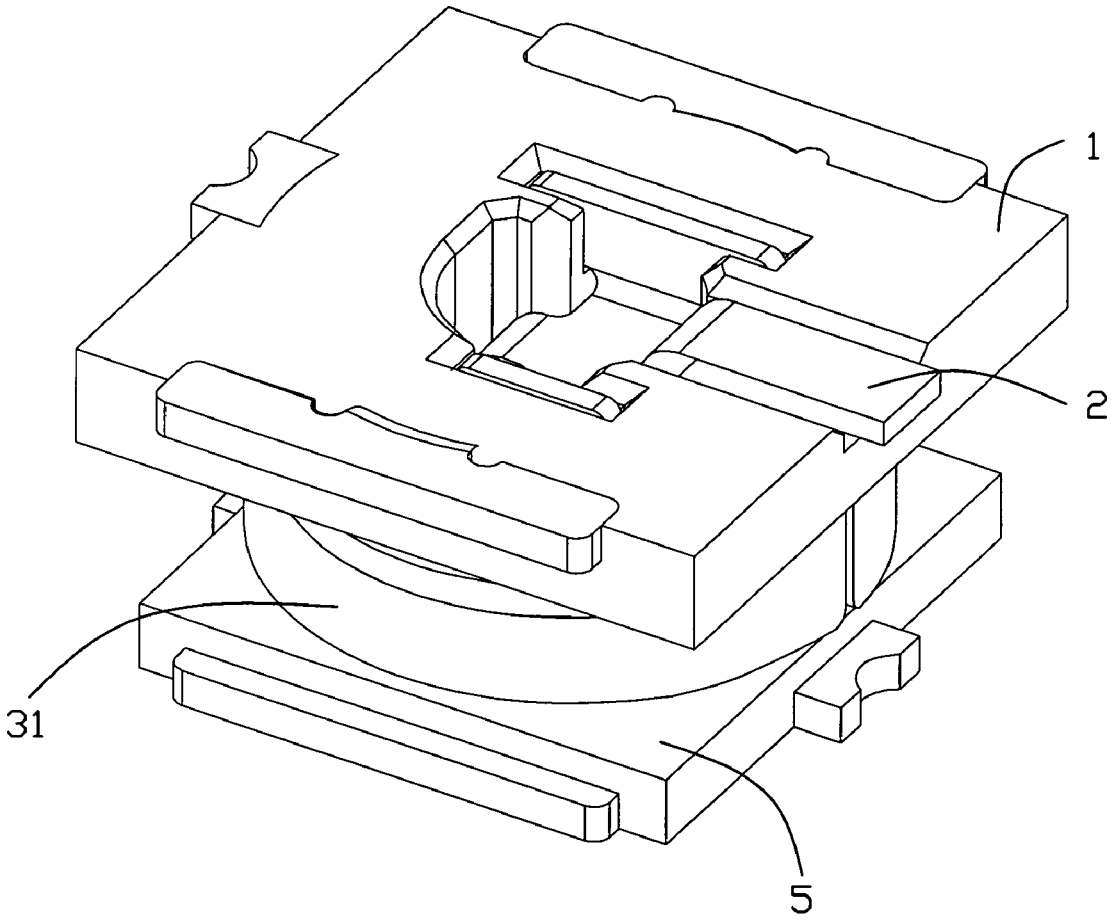
FIG. 6 is an assembled, perspective view of the RF connector assembly of FIG. 5.

Referring to FIGS. 2 to 6, an RF connector assembly according to an embodiment of the present invention is shown to include a receptacle RF connector 100 and a plug connector 200 for mating with each other.

The receptacle RF connector 100 includes an inner conductor 2, a dielectric block 1 assembled with the conductor 2, and an outer shell 3 integrally molded with the dielectric block 1 as a unit.

The inner conductor 2 includes a base 21 with opposite first and second sides, and opposite third and fourth sides thereof, a first unsealed tubular section 26 having a portion attached to the first side, a pair of retention walls 23 and 24 respectively attached to the third and fourth sides, and a solder leg formed of a zigzag shape and disposed on the second side with a solder tail 22 for surface mounted onto a first printed circuit board (not shown). The first unsealed tubular section 20 is formed by curling around an axial direction orthogonal to the base 21, and having its initial axial edge parallel to the axial direction, a parallel terminating axial edge adjacent to a side wall 25, which extends directly and upwardly from the first side of the base 21 of the conductor 2, and a periphery bottom edge both vertical to the initial axial edge and the terminating axial edge. The periphery bottom edge is spaced from and above the base 21 of the conductor 2 with a distance. The initial axial edge of the first unsealed tubular section 26 is connected to a corresponding vertical side edge of the side wall 25.

The pair of retention walls 23 and 24 is disposed in an opposite relationship with respect to the solder tail 22 and vertical to the base 21 of the conductor 2, with one retention wall 23 having a T shape and the other 24 having an L shape. The retention wall 23, 24 has a retention rib 231, 241 on at least one side edge of the retention wall 23, 24. The retention walls 23, 24 are configured to extend into a body of the dielectric block 1. The dielectric block 1 of the receptacle RF connector 100 has retention slots 11, 12 for the respective retention walls 23, 24 to be interferentially engaged therewith. Thus, the conductor 2 is securely held within the dielectric block 1 by the engagement of the retention walls 23, 24 and the retention slots 11, 12 so as to avoid the un-stable assembly of the conductor 2 and the dielectric block 1 of the prior art merely by means of the zigzag solder leg.

The dielectric block 1 has a second tubular section 16 disposed outside of the first tubular section 26 of the conductor 2 with an axial cutout 161 on an inner surface of the second tubular section 16.

The outer shell 3 has a third unsealed tubular frame 31 with an axial slit 312 also along the axial direction of the first unsealed tubular section 20, and three solder pads 32 located around the periphery of the tubular frame 31. The three solder pads 32 are at a same level with the solder tail 22 of the conductor 2. The third tubular frame 31 is spaced from the second tubular section 16 in a radial direction with a predetermined distance for mating with the plug connector 200. The outer shell 3 also includes a locking groove 310 on an inner ring of the third unsealed tubular frame 31 of the shell 3.

The plug connector 200 includes a central conductor 8 having a tubular contact section for plugging into the first unsealed tubular section 26 of the receptacle RF connector 100, and a radial section 6 extending outwardly from a bottom of said tubular contact section 26. An outer shell 4 has an unsealed tubular frame with solder pads 7 around the periphery of the shell 4, with the solder pads 7 located on a second common plane for surface mounted onto a second printed circuit board (not shown). The solder pads 7 are located on a second common plane with that of the radial section 6. The second common plane is arranged parallel to the first plane of the receptacle RF connector 100. The outer shell 4 of the plug connector 200 includes a plurality of dimples 41 on an outer ring of the unsealed tubular frame of the plug connector 200 for interferentially engaging with the outer shell 3 of the receptacle RF connector 100 so as to securely mate the plug connector 200 and the receptacle RF connector 100. A dielectric block 5 is integrally molded with the central conductor 6 and the outer shell 4 as a unit.

While the present invention has been described with reference to preferred embodiments, the description of the invention is illustrative and is not to be construed as limiting the invention. Various modifications to the present invention can be made to preferred embodiments by those skilled in the art without departing from the true spirit and scope of the invention as defined by the appended claims.

What is claimed is:

1. A receptacle RF connector, comprising:

an inner conductor including a base with opposite first and second sides, and opposite third and fourth sides;

a first unsealed tubular section having a portion attached to the first side and defining an axial direction orthogonal to the base;

a solder leg disposed on said second side with a solder tail; and retention walls respectively attached to said third and fourth sides;

a dielectric block assembled with the conductor, the block having a second tubular section disposed outside of the first tubular section of the conductor;

wherein the retention walls are configured to extend into a body of the dielectric block; and an outer shell integrally molded with the dielectric block as a unit, the outer shell having a third unsealed tubular frame with an axial slit also along said axial direction, and three solder pads being at a same level with said solder tail of the conductor, the third tubular frame spaced from the second tubular section in a radial direction with a predetermined distance.

2. The receptacle RF connector of claim 1, wherein the dielectric block of the receptacle RF connector has retention slots for the retention walls to be interferentially engaged therewith.

3. The receptacle RF connector of claim 1, wherein the first unsealed tubular section has an initial axial edge along said axial direction and connected to a vertical edge of a side wall, which is located on the first side of the base, a terminating axial edge parallel to the initial axial edge and proximate to the side wall, and a periphery bottom edge both vertical to the initial axial edge and the terminating axial edge, the periphery bottom edge spaced from and above the base of the conductor with a distance.

4. The receptacle RF connector of claim 1, wherein each of the retention walls is essentially arranged vertical to the base of the conductor.

5. The receptacle RF connector of claim 4, wherein the retention wall has a retention rib on at least one side edge of the retention wall.

6. The receptacle RF connector of claim 1, wherein the outer shell includes a locking groove disposed on an inner ring of the third unsealed tubular frame of the shell.

7. A RF connector assembly, comprising:

a receptacle RF connector, comprising:

an inner conductor having a first unsealed tubular section with a solder tail and a pair of retention walls around the periphery of the tubular section;

an outer shell having a second unsealed tubular frame with solder pads around the periphery of the tubular frame, the solder pads being on a first common plane with that of said solder tail;

a dielectric block integrally molded with the outer shell as a unit and further assembled with the inner conductor; and wherein the retention walls are configured to extend into a body of the dielectric block;

a plug connector for mating with the receptacle RF connector, comprising:

a central conductor having a tubular contact section for plugging into the first unsealed tubular section of the receptacle RF connector;

a radial section extending outwardly from a bottom of said tubular contact section;

an outer shell having an unsealed tubular frame with solder pads around the periphery of the shell, the solder pads located on a second common plane with that of the radial section;

a dielectric block integrally molded with the central conductor and the outer shell as a unit; wherein said second plane is arranged parallel to the first plane.

8. The RF connector assembly of claim 7, wherein the pair of retention walls is disposed in an opposite relationship with respect to the solder tail.

9. The RF connector assembly of claim 7, wherein the first unsealed tubular section is connected to a side of a base of the inner conductor.

10. The RF connector assembly of claim 9, wherein the first unsealed tubular section is formed by curling around an axial direction and having its initial axial edge, parallel to said axial direction, connected to a corresponding side edge of a side wall, which extends upwardly from one side of a base of the conductor of the receptacle RF connector, the tubular section having its terminating axial edge adjacent said side wall.

11. The RF connector assembly of claim 7, wherein the dielectric block of the receptacle RF connector has retention slots for the retention walls to be interferentially engaged therewith.

12. The RF connector assembly of claim 11, wherein each of the retention walls has a retention rib on at least one side edge of each retention wall.

13. The RF connector assembly of claim 7, wherein the outer shell of the plug connector includes a plurality of dimples on an outer ring of the unsealed tubular frame of the plug connector.

14. An RF connector assembly comprising:

an insulative housing defining opposite upper and bottom surfaces with a center through hole extending there-through, and a recess formed in the bottom surface to communicate said center through hole to an exterior;

at least one slot formed in said bottom surface and communicatively located by two sides of the center through hole; and a unitary conductive inner contact including a middle cross section defining a lengthwise direction and a transverse direction perpendicular to each other, further including at least one retention wall located on one side of said cross section in said transverse direction, and a tubular contact section and a surface mounting section located on two sides of said cross section in said lengthwise direction; wherein the tubular contact section is received in the center through hole, the surface mounting section is received in the recess, and the retention wall is received in the slot.

15. The RF connector assembly as claimed in claim 14, wherein said inner contact is upwardly assembled to the housing from the bottom surface.

16. The RF connector assembly as claimed in claim 15, further including a unitary conductive outer contact defining an outer shell with a plurality of solder pads assembled to the housing in an insert molding manner; wherein said outer shell essentially encloses the tubular section.

17. The RF connector assembly as claimed in claim 16, wherein one of said solder pads and the surface mounting section are oppositely located by two sides of the tubular section in said lengthwise direction, while the other of said solder pads and said retention wall are either located on a same side or on two opposite sides of said tubular section in said transverse direction.

18. The RF connector assembly as claimed in claim 14, further including another retention wall located on the other side of the tubular section in said transverse direction.

19. The RF connector assembly as claimed in claim 18, wherein said retention wall is L-shaped while said another retention wall is T-shaped.

20. The RF connector assembly as claimed in claim 19, wherein extension of said tubular section begins close to the retention wall while terminating close to said another retention wall.

* * * * *